US007423388B2

(12) United States Patent
Meng

(10) Patent No.: US 7,423,388 B2
(45) Date of Patent: Sep. 9, 2008

(54) FIXED LAMP FREQUENCY SYNCHRONIZATION WITH THE RESONANT TANK FOR DISCHARGE LAMPS

(75) Inventor: David Meng, Los Altos, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 404 days.

(21) Appl. No.: 11/355,130

(22) Filed: Feb. 15, 2006

(65) Prior Publication Data

US 2007/0188106 A1 Aug. 16, 2007

(51) Int. Cl.
*H05B 37/02* (2006.01)

(52) U.S. Cl. ..... 315/307; 315/209 R

(58) Field of Classification Search ..... 315/209 R, 315/224–226, 246, 291, 307–308, DIG. 5
See application file for complete search history.

(56) References Cited

U.S. PATENT DOCUMENTS 5,977,725 A * 11/1999 Miyazaki et al. ..... 315/291
6,362,575 B1 * 3/2002 Chang et al. ..... 315/224
6,384,544 B1 * 5/2002 Greenwood et al. ..... 315/291
6,633,138 B2 10/2003 Shannon et al.
6,791,279 B1 * 9/2004 Shearer et al. ..... 315/209 R
6,919,694 B2 7/2005 Moyer et al.
2006/0097655 A1 * 5/2006 Takahashi et al. ..... 315/246

OTHER PUBLICATIONS

U.S. Appl. No. 11/212,487, filed Aug. 25, 2005, Yao et al.

* cited by examiner

*Primary Examiner*—Thuy Vinh Tran
*Assistant Examiner*—Tung X Le
(74) *Attorney, Agent, or Firm*—Perkins Coie LLP; Zhou Lu

(57) ABSTRACT

Control methods and apparatus are disclosed for operating a full-bridge inverter at resonant frequency mode, hybrid frequency mode, and fixed frequency mode. The operating frequency of the inverter equals to the user programmed frequency if the user programmed frequency is above the resonant tank frequency; and the operating frequency is synchronized with the resonant tank frequency if the user programmed frequency is below the resonant tank frequency.

16 Claims, 4 Drawing Sheets

FIXED LAMP FREQUENCY SYNCHRONIZATION WITH THE RESONANT TANK FOR DISCHARGE LAMPS

TECHNICAL FIELD

The present invention relates to the driving of fluorescent lamps, and more particularly, to methods and protection schemes for driving cold cathode fluorescent lamps (CCFL), external electrode fluorescent lamps (EEFL), and flat fluorescent lamps (FFL).

BACKGROUND

A CCFL (Cold Cathode Fluorescent Lamp) inverter with its switching frequency adapted to the resonant tank frequency produces a power conversion with high efficiency and provides reliable lamp striking and open lamp voltage regulation. In a variable frequency control method, the switch is always turned on when $I_L$ crosses zero, wherein $I_L$ is the resonant current of the transformer's primary winding. However, this design approach has certain disadvantages. It produces big variations of switching frequencies when input voltage, lamp current, or when liquid crystal display (LCD) panels are changed. If the frequency variation range becomes too wide, there is potential electric-magnetic interference (EMI) between the LCD panel and the CCFL inverter.

A CCFL inverter with a fixed frequency control method does not have the EMI problem. In this method, the switching turn-on time is regulated by a clock and the switching frequency is fixed by the designed parameters. However, there is no control of the phase relationship between supply voltage and resonant current, which may cause poor crest factor, poor lamp efficiency, start-up lamp current spiking, and open lamp voltage regulation.

Accordingly, improvements are needed to utilize the advantages of both the variable-frequency and fixed-frequency control methods.

DETAILED DESCRIPTION

Embodiments of a system and methods that control a full-bridge inverter are described in detail herein. In the following description, some specific details, such as example circuits and example values for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with systems, circuits, and methods that are meant to be exemplary and illustrative. In various embodiments, the above problem has been reduced or eliminated, while other embodiments are directed to other improvements.

The present invention relates to circuits and methods of controlling the operating frequency of a full-bridge inverter that includes a resonant tank. Proposed circuits can generate a zero-crossing signal of $I_L$, generate a user programmed oscillating signal, and determine the operating frequency of the inverter to achieve good crest factor, high lamp efficiency, and reliable lamp striking.

Figure 1:
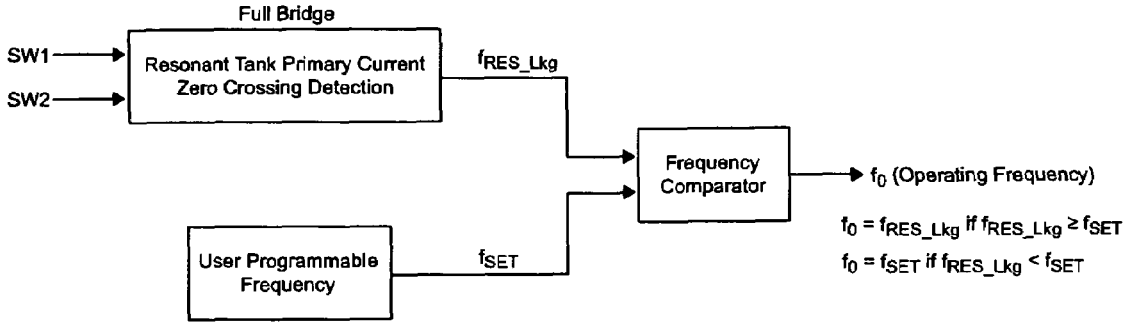
FIG. 1 illustrates a circuit block diagram of the present invention.

FIG. 1 illustrates a circuit block diagram of the present invention in a full-bridge inverter that has a resonant tank. An oscillating signal with a user programmed frequency $f_{set}$ is generated by a user programmed oscillator. A zero-crossing signal with the loaded resonant tank frequency $f_{res\text{-}lkg}$ is generated by sensing the zero-crossing of $I_L$. The oscillating signal and the zero-crossing signal are compared and used to determine the operating frequency $f_0$ of the full-bridge inverter.

Figure 1A:
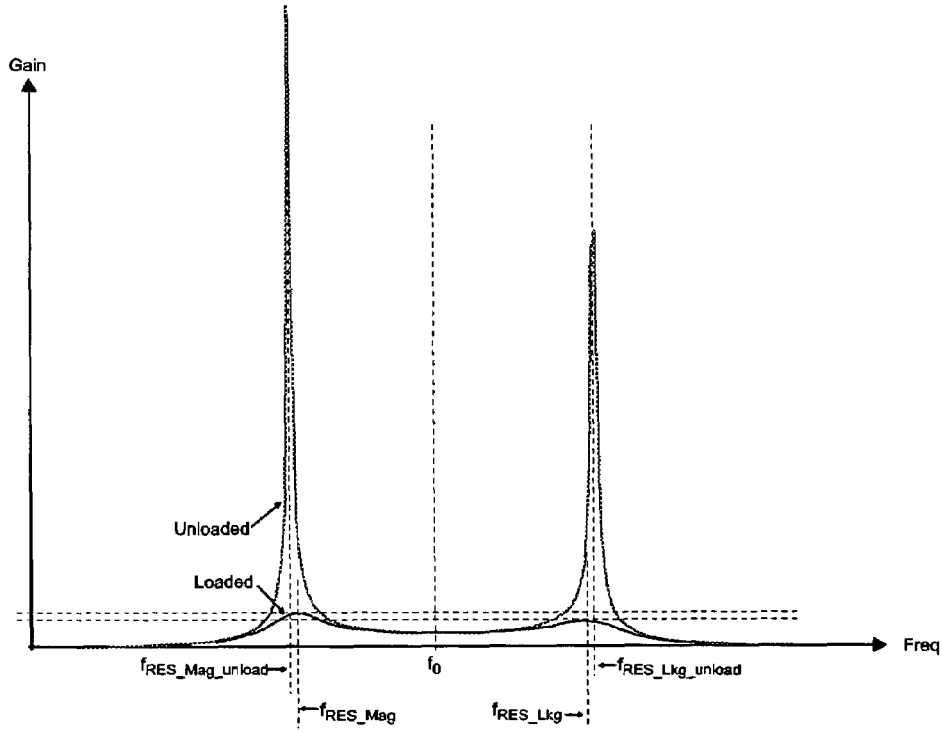
FIG. 1A is an example of gain curves of a typical CCFL inverter versus frequency.

If the resonant tank frequency $f_{res\text{-}lkg}$ is below the user programmed frequency $f_{set}$, $f_0$ equals the user programmed frequency $f_{set}$ and discharge lamps are driven at $f_{set}$. If the resonant tank frequency $f_{res\text{-}lkg}$ is above the user programmed frequency $f_{set}$, the operating frequency is synchronized with $f_{res\text{-}lkg}$. However, the operating frequency can only be synchronized UP if $f_{set}$ is below $f_{res\text{-}lkg}$ and cannot be synchronized DOWN if $f_{set}$ is above $f_{res\text{-}lkg}$. As indicated in FIG. 1A, the resonant tank frequency $f_{res\text{-}lkg}$ is the loaded tank leakage resonant frequency hereafter.

The present invention allows discharge lamps to operate in three different frequency modes.

Mode 1: Resonant Frequency Mode

Figure 2:
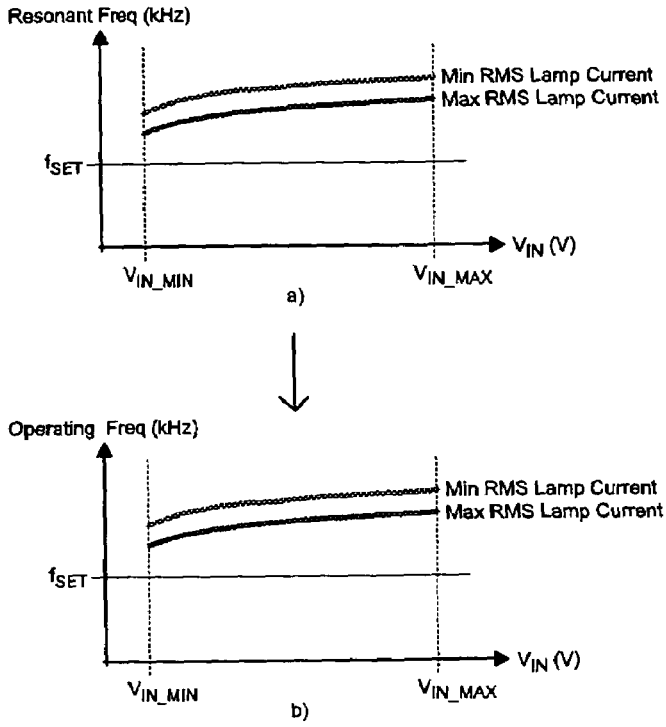
FIGS. 2 (*a*) and (*b*) illustrate the resonant frequency versus the input voltage in resonant frequency mode.

Mode 1 is illustrated in FIGS. 2(*a*) and 2(*b*). In mode 1, the user programmed frequency, $f_{set}$, is set below the resonant tank frequency with a maximum RMS lamp current. In this mode, the operating frequency $f_0$ is synchronized with the resonant tank frequency.

Mode 2: Hybrid Frequency Mode

Figure 3:
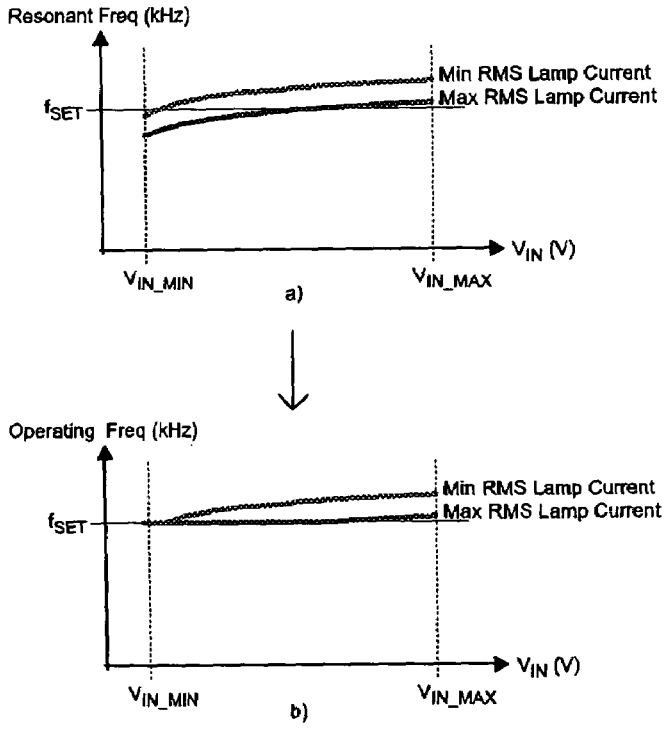
FIGS. 3 (*a*) and (*b*) illustrate the resonant frequency versus the input voltage in hybrid frequency mode.

Mode 2 is illustrated in FIGS. 3(*a*) and 3(*b*). In mode 2, the user programmed frequency, $f_{set}$, is set between the loaded resonant tank frequency $f_{res\text{-}lkg}$ with a maximum RMS lamp current, and the loaded resonant tank frequency $f_{res\text{-}lkg}$ with a minimum RMS lamp current. During startup and open lamp condition, the operating frequency $f_0$ is temporarily shifted up toward the unloaded resonant tank frequency. After the lamp is struck, $f_0$ returns to its set value if the input voltage is low; and $f_0$ is synchronized with the loaded resonant tank frequency if the input voltage is high. In other words, $f_0$ equals $f_{set}$ when $f_{res\text{-}lkg}<f_{set}$; and $f_0$ is synchronized with $f_{res\text{-}lkg}$ when $f_{res\text{-}lkg}\geqq f_{set}$. There are many advantages by using the hybrid frequency mode. It limits frequency variations versus the supply voltage while maintaining good crest factor if the input voltage is high.

Mode 3: Fixed Frequency Mode

Figure 4:
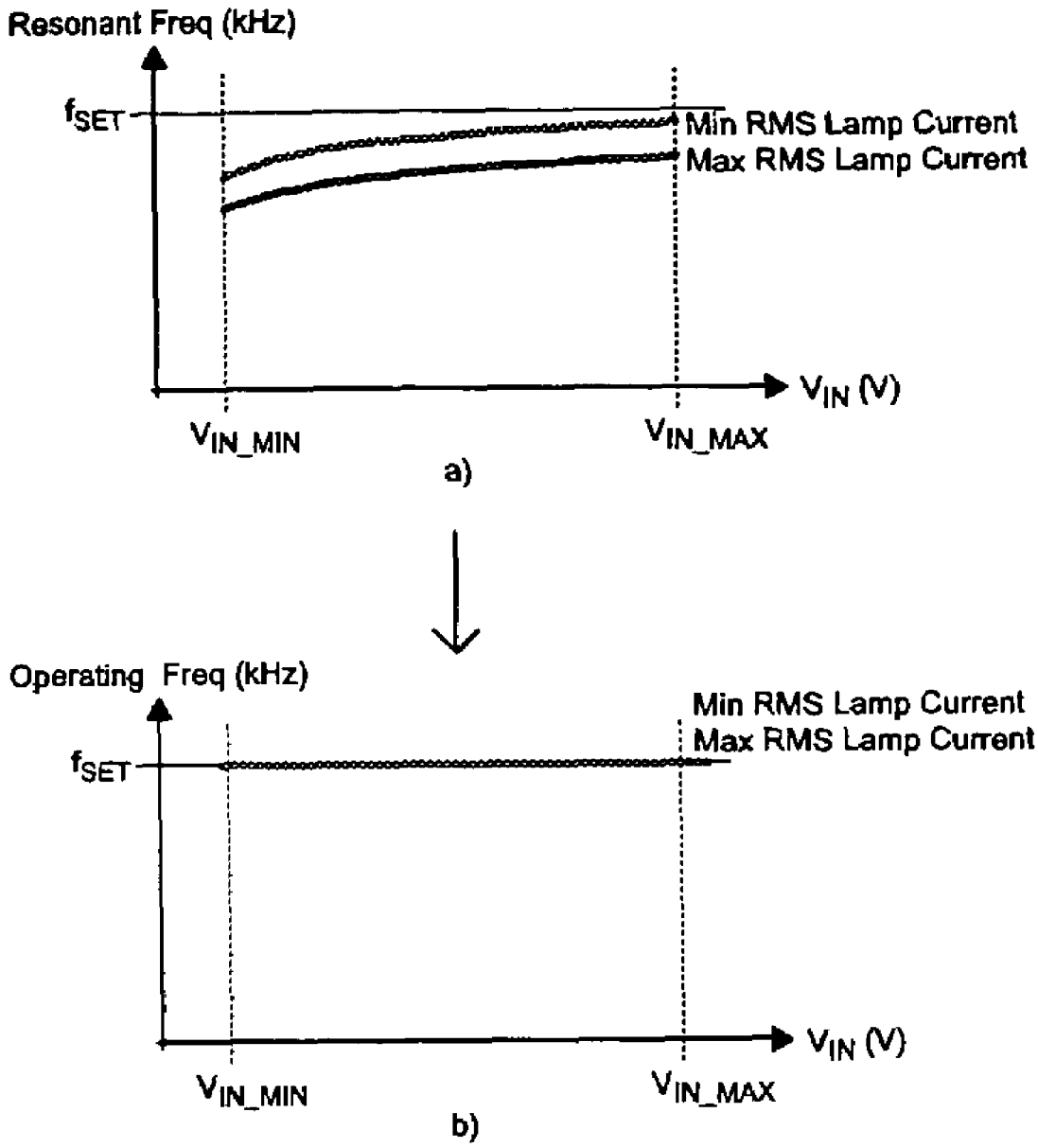
FIGS. 4 (*a*) and (*b*) illustrate the resonant frequency versus the input voltage in fixed frequency mode.
Figure 5:
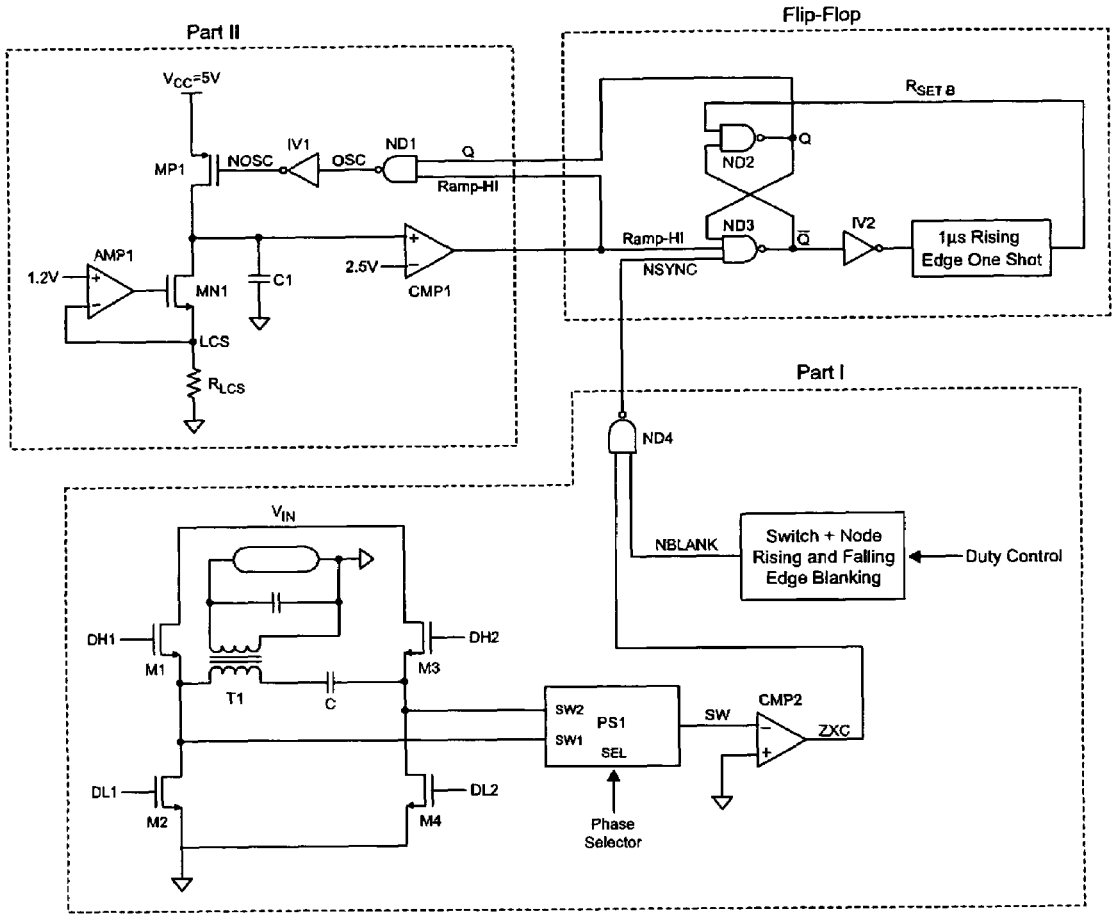
FIG. 5 illustrates an example of embodiments of the present invention in a full-bridge inverter.

Mode 3 is illustrated in FIGS. 4(*a*) and 4(*b*). In mode 3, the user programmed frequency, $f_{set}$, is set above the loaded resonant tank frequency with a minimum RMS lamp current. The operating frequency $f_0$ is temporarily shifted up toward the unloaded resonant tank frequency during startup or open lamp condition. After the lamp is struck, the operating frequency returns to $f_{set}$.

An example of the embodiments of the present invention is illustrated in a full-bridge inverter of FIG. 6. The circuit contains two parts and a flip-flop. Part I contains a phase selector PS1 and a comparator CMP2 that are designed to sense the zero-crossing point of the primary current and generate a zero-crossing signal with the resonant tank frequency. The phase selector PS1 is designed to select a switching node SW from SW1 and SW2 based on the switches' turn-on sequence and outputs SW to the negative terminal of the comparator CMP2 whose positive terminal is grounded. CMP2 is a zero-crossing signal generator. Switching noises, generated when inverters' switches are turned on and turned off, can easily cause the primary current zero-crossing circuitry to be falsely triggered. Either filtering or a blanking technique is required to resolve the problem. In FIG. 6, SYNC is blanked for a fixed amount of time when any switch of the full-bridge inverter is turned on or turned off. CMP2's output signal, SYNC, and the blanking signal NBLANK are combined through an NAND gate. The output signal NSYNC of the NAND gate is one input signal of the flip-flop.

Part II is a user programmed oscillator that contains an amplifier AMP1, a PMOS transistor, an NMOS transistor, a resistor $R_{LCS}$, and a comparator CMP1. The comparator CMP1 compares a ramp signal RAMP and 2.5V. CMP1's output signal RAMP_HI is the other input signal of the flip-flop. RAMP_HI and the flip-flop's output signal Q are the input signals of an NAND gate ND1 and then outputs to an inverter IN1. The output signal of IN1 follows AND logic of RAMP_HI and Q and it is used to control the gate terminal of the PMOS MP1; and in turn determines the ramping cycle of the ramp signal RAMP. RAMP_HI and NSYNC are the two input signals of the flip-flop and either of them can set the flip-flop. If the resonant tank frequency $f_{res\text{-}lkg}$ of Part I is above the programmed frequency $f_{set}$ of Part II, NSYNC sets the flip-flop and RAMP discharge cycle is terminated early before reach 2.5V. If the resonant tank frequency $f_{res\text{-}lkg}$ of Part I is below the programmed frequency $f_{set}$ of Part II, RAMP_HI sets the flip-flop and RAMP discharge cycle is determined by user.

In the present invention, circuits and methods are introduced to control the operating frequency of a full-bridge inverter that has a resonant tank. A zero-crossing signal with the resonant tank frequency is generated by sensing $I_L$; and an oscillating signal with a user programmed frequency is generated by a user programmed oscillator. The zero-crossing signal and the oscillating signal are compared and used to derive the operating frequency of the full-bridge inverter. The operating frequency $f_0$ of the inverter is determined by either the oscillating signal or the zero-crossing signal whoever has a higher frequency. In other word, $f_0$ equals to the user programmed frequency $f_{set}$ if $f_{set}$ is above $f_{res\text{-}lkg}$; and $f_0$ is synchronized with the loaded resonant tank frequency $f_{res\text{-}lkg}$ if $f_{set}$ is below $f_{res\text{-}lkg}$. The operating frequency $f_0$ is allowed to operate in three modes. In resonant mode, the operating frequency is synchronized with the loaded resonant tank frequency. In hybrid mode, the operating frequency $f_0$ equals to the user programmed frequency if the input voltage is low; and the operating frequency $f_0$ is synchronized with the loaded resonant tank frequency if the input voltage is high. In fixed frequency mode, the operating frequency $f_0$ equals to the user programmed frequency.

The description of the invention and its applications as set forth herein is illustrative and is not intended to limit the scope of the invention. Variations and modifications of the embodiments disclosed herein are possible, and practical alternatives to and equivalents of the various elements of the embodiments are known to those of ordinary skill in the art. Other variations and modifications of the embodiments disclosed herein may be made without departing from the scope and spirit of the invention.

I claim:

1. A method for controlling a full-bridge inverter that includes a resonant tank, the method comprising:

generating an oscillating signal that is characterized by a user programmed frequency and generated by a user programmed oscillator;

generating a zero-crossing signal with a loaded resonant tank frequency of said full-bridge inverter; and deriving an operating frequency of said full-bridge inverter based on said oscillating signal and said zero-crossing signal wherein:

if said user programmed frequency is above said loaded resonant tank frequency, said operating frequency being substantially said user programmed frequency;

if said user programmed frequency is below or equal to said loaded resonant tank frequency, said operating frequency being substantially synchronized with said loaded resonant tank frequency.

2. The method in claim 1, wherein said zero-crossing signal is generated by sensing a zero-crossing point of said inverter's primary current.

3. The method in claim 2, wherein said zero-crossing signal is blanked or filtered for a fixed amount of time when any switch of said full-bridge inverter is turned on or turned off.

4. The method in claim 1, wherein said oscillating signal and said zero-crossing signal are the two input signals of a flip-flop wherein said flip-flop is set by either said oscillating signal or said zero-crossing signal depending upon which has a higher frequency.

5. The method in claim 1, wherein said operating frequency can be in three frequency modes:

if said user programmed frequency is set below said loaded resonant tank frequency with a maximum RMS lamp current, said operating frequency is substantially synchronized with said loaded resonant tank frequency;

if said user programmed frequency is set between said loaded resonant tank frequency with a maximum RMS lamp current and said loaded resonant tank frequency with a minimum RMS lamp current, said operating frequency is substantially said user programmed frequency if the input voltage is low, and said operating frequency is substantially synchronized with said loaded resonant tank frequency if the input voltage is high; and if said user programmed frequency is set above said loaded resonant tank frequency with a minimum RMS lamp current, said operating frequency is substantially said user programmed frequency.

6. A circuit for controlling a full-bridge inverter that includes a resonant tank, said circuit comprising:

a zero-crossing detector coupled to the resonant tank of said full-bridge inverter, said zero-crossing detector outputting a zero-crossing signal;

a user programmed oscillator for generating an oscillating signal at a user programmed frequency; and a flip-flop that is set by either said zero-crossing signal or said oscillating signal, whichever has a high frequency;

wherein the ramping cycle of said user programmed oscillator is determined by said flip-flop's output signal and said oscillating signal.

7. The circuit in claim 6, wherein said zero-crossing signal is blanked or filtered for a fixed amount of time when any switch of said full-bridge inverter is turned on or turned off.

8. The circuit in claim 7, wherein said zero-crossing signal is generated by a phase selector and a zero-crossing signal generator.

9. The method in claim 6, wherein said flip-flop is set by either said oscillating signal or said zero-crossing signal whoever has a higher frequency.

10. The circuit in claim 6, wherein the operating frequency of said full-bridge inverter is determined by said zero-crossing signal and said oscillating signal:

if said user programmed frequency is above said loaded resonant tank frequency, said operating frequency is substantially said user programmed frequency;

if said user programmed frequency is below said loaded resonant tank frequency, said operating frequency is substantially synchronized with said loaded resonant tank frequency.

11. The circuit in claim 10, wherein said full-bridge inverter is operated in three frequency modes:

if said user programmed frequency is set below said loaded resonant tank frequency with a maximum RMS lamp current, said operating frequency is substantially synchronized with said loaded resonant tank frequency;

if said user programmed frequency is set between said loaded resonant tank frequency with a maximum RMS lamp current and said loaded resonant tank frequency with a minimum RMS lamp current, said operating frequency is substantially said user programmed frequency if the input voltage is low, and said operating frequency is substantially synchronized with said loaded resonant tank frequency if the input voltage is high; and if said user programmed frequency is set above said loaded resonant tank frequency with a minimum RMS lamp current, said operating frequency is substantially said user programmed frequency.

12. An apparatus for controlling a full-bridge inverter that includes a resonant tank, the apparatus comprising:

means for generating an oscillating signal that is characterized by a user programmed frequency;

means for generating a zero-crossing signal using a loaded resonant tank frequency of said full-bridge inverter; and means for deriving an operating frequency of said full-bridge inverter based on said oscillating signal and said zero-crossing signal wherein:

if said user programmed frequency is above said loaded resonant tank frequency, said operating frequency is substantially said user programmed frequency;

if said user programmed frequency is below or equal to said loaded resonant tank frequency, said operating frequency is substantially synchronized with said loaded resonant tank frequency.

13. The apparatus in claim 12, wherein said zero-crossing signal is generated by sensing a zero-crossing point of said inverter's primary current.

14. The apparatus in claim 13, wherein said zero-crossing signal is blanked or filtered for a fixed amount of time when any switch of said full-bridge inverter is turned on or turned off.

15. The apparatus in claim 12, wherein said oscillating signal and said zero-crossing signal are the two input signals of a flip-flop wherein said flip-flop is set by either said oscillating signal or said zero-crossing signal whoever has a higher frequency.

16. The apparatus in claim 12, wherein said operating frequency is operated in three frequency modes:

if said user programmed frequency is set below said loaded resonant tank frequency with a maximum RMS lamp current, said operating frequency is synchronized with said loaded resonant tank frequency;

if said user programmed frequency is set between said loaded resonant tank frequency with a maximum RMS lamp current and said loaded resonant tank frequency with a minimum RMS lamp current, said operating frequency equals to said user programmed frequency if the input voltage is low, and said operating frequency is synchronized with said loaded resonant tank frequency if the input voltage is high; and if said user programmed frequency is set above said loaded resonant tank frequency with a minimum RMS lamp current, said operating frequency equals to said user programmed frequency.

* * * * *